US012449122B2

(12) United States Patent
Zink et al.

(10) Patent No.: US 12,449,122 B2
(45) Date of Patent: Oct. 21, 2025

(54) FREE-JET BURNER AND METHOD FOR LOW $CO_2$, $NO_x$, AND CO EMISSIONS

(71) Applicant: ZEECO INC., Broken Arrow, OK (US)

(72) Inventors: Darton J Zink, Tulsa, OK (US); Rex K Isaacs, Collinsville, OK (US); Eric G Pratchard, Tulsa, OK (US); John Petersen, Pawnee, OK (US); Tim Kirk, Morris, OK (US); Austin White, Tulsa, OK (US); Zach Chandler, Tulsa, OK (US)

(73) Assignee: ZEECO, INC., Broken Arrow, OK (US)

( * ) Notice: Subject to any disclaimer, the term of this patent is extended or adjusted under 35 U.S.C. 154(b) by 446 days.

(21) Appl. No.: 17/986,326

(22) Filed: Nov. 14, 2022

(65) Prior Publication Data

US 2024/0159392 A1 May 16, 2024

(51) Int. Cl.
*F23D 14/32* (2006.01)

(52) U.S. Cl.
CPC ..... *F23D 14/32* (2013.01); *F23D 2203/005* (2013.01)

(58) Field of Classification Search
CPC ..... F23D 14/32; F23D 2203/005
USPC ..... 431/356
See application file for complete search history.

(56) References Cited

U.S. PATENT DOCUMENTS

| | | | |
|---|---|---|---|
| 1,889,548 | A | 11/1932 | Joseph |
| 2,573,502 | A | 10/1951 | Smith, Jr. |
| 3,289,731 | A | 12/1966 | Guslav |
| 3,343,418 | A | 9/1967 | Branche |
| 3,349,826 | A | 10/1967 | Poole |
| 3,439,997 | A | 4/1969 | Hancock |
| 3,548,592 | A | 12/1970 | Hopkins |
| 3,905,755 | A | 9/1975 | Aske |
| 4,277,952 | A | 7/1981 | Egnell et al. |
| 4,395,223 | A | 7/1983 | Okigami et al. |
| 4,473,349 | A | 9/1984 | Kumatsu |
| 4,575,332 | A | 3/1986 | Oppenberg et al. |
| 4,629,413 | A | 12/1986 | Michelson |

(Continued)

FOREIGN PATENT DOCUMENTS

| | | |
|---|---|---|
| DE | 3628293 | 2/1988 |
| EP | 1108952 | 6/2001 |

(Continued)

OTHER PUBLICATIONS

PCT/US2021/031796—International Preliminary Report With International Search Report and Written Opinion; Sep. 20, 2021.

(Continued)

*Primary Examiner* — Avinash A Savani
(74) *Attorney, Agent, or Firm* — Dennis D. Brown; Brown Patent Law, P.L.L.C.

(57) ABSTRACT

A plugging resistant, highly stable free jet burner and method which provide Ultra-Low $NO_x$ emissions for any fuel using angular ejection, large ejection ports, auxiliary burner tips, and wide tip-to-tip spacing, and which also permit the use of a high-hydrogen or 100% hydrogen fuel to reduce or substantially eliminate carbon dioxide emissions.

22 Claims, 10 Drawing Sheets

(56) References Cited

U.S. PATENT DOCUMENTS

| | | | |
|---|---|---|---|
| 4,702,691 | A | 10/1987 | Ogden |
| 4,708,638 | A | 11/1987 | Brazier et al. |
| 5,044,932 | A | 9/1991 | Martin et al. |
| 5,073,105 | A | 12/1991 | Martin et al. |
| 5,098,282 | A | 3/1992 | Schwartz et al. |
| 5,134,985 | A | 8/1992 | Rao |
| 5,195,884 | A | 3/1993 | Schwartz |
| 5,284,438 | A | 2/1994 | McGill et al. |
| 5,441,404 | A | 8/1995 | Christenson |
| 5,458,481 | A | 10/1995 | Surbey et al. |
| 5,542,840 | A | 8/1996 | Surbey et al. |
| 5,713,206 | A | 2/1998 | McWhirter |
| 5,799,594 | A | 9/1998 | Rao |
| 5,813,846 | A | 9/1998 | Newby |
| 5,957,678 | A | 9/1999 | Endoh |
| 5,980,243 | A | 11/1999 | Surbey et al. |
| 5,984,673 | A | 11/1999 | Bossetti |
| 6,007,325 | A | 12/1999 | Loftus et al. |
| 6,089,170 | A | 7/2000 | Conti et al. |
| 6,379,146 | B1 | 4/2002 | Zink et al. |
| 6,394,792 | B1 | 5/2002 | McDonald et al. |
| 6,499,990 | B1 | 12/2002 | Zink et al. |
| 6,565,361 | B2 | 5/2003 | Jones |
| 6,626,661 | B1 | 9/2003 | Zink et al. |
| 6,675,581 | B1 | 1/2004 | Stuttaford |
| 6,729,874 | B2 | 5/2004 | Poe |
| 6,875,008 | B1 | 4/2005 | Martin |
| 7,198,482 | B2 | 4/2007 | Chung |
| 7,670,135 | B1 | 3/2010 | Zink et al. |
| 7,878,798 | B2 | 2/2011 | Poe |
| 9,194,579 | B2 | 11/2015 | Martin |
| 9,222,668 | B2 | 12/2015 | Zink et al. |
| 9,593,847 | B1 | 3/2017 | Zink |
| 9,593,848 | B2 | 3/2017 | Zink et al. |
| 9,835,089 | B2 | 12/2017 | Zuo |
| 2001/0018171 | A1 | 8/2001 | Al-Halbouni |
| 2001/0034001 | A1 | 10/2001 | Poe et al. |
| 2003/0175638 | A1 | 9/2003 | Stephens |
| 2004/0018461 | A1 | 1/2004 | Stephens |
| 2005/0252996 | A1 | 11/2005 | Nozaki |
| 2007/0122756 | A1* | 5/2007 | Wunning ..... F23D 91/02 431/11 |
| 2009/0294421 | A1 | 12/2009 | Hu |
| 2013/0122440 | A1 | 5/2013 | Zink |
| 2013/0230811 | A1 | 9/2013 | Goodson et al. |
| 2014/0065558 | A1 | 3/2014 | Colannino et al. |
| 2017/0198902 | A1 | 7/2017 | Zink et al. |
| 2017/0336068 | A1 | 11/2017 | Martin |
| 2019/0309942 | A1 | 10/2019 | Zink et al. |
| 2021/0050736 | A1 | 2/2021 | Bordes et al. |
| 2021/0080101 | A1 | 3/2021 | Zink et al. |
| 2021/0356122 | A1 | 11/2021 | Zink et al. |

FOREIGN PATENT DOCUMENTS

| | | |
|---|---|---|
| GB | 2101734 | 5/1982 |
| JP | 2015004483 | 1/2015 |
| WO | 2021050736 | 3/2021 |

OTHER PUBLICATIONS

Platvoet, et al; Process Burners 101; AIChE; Aug. 2013; pp. 35-39; US.

CLSF Free-Jet Round Flame Combination Burner; Dec. 16, 2019; Zeeco; US.

PCT/US2019/025508; Corrected international Search Report and Written Opinion; Apr. 3, 2019; US.

PCT/US2020/050211—International Preliminary Report with International Search Report and Written Opinion; Dec. 3, 2020.

PCT/US23/78825—International Search Report and Written Opinion—Mar. 1, 2024—Zeeco, Inc.

* cited by examiner

FREE-JET BURNER AND METHOD FOR LOW $CO_2$, $NO_x$, AND CO EMISSIONS

FIELD OF THE INVENTION

The present invention relates to free-jet burners and methods for burning fuels comprising up to 100% $H_2$ to produce very low $CO_2$ emissions while also producing low levels of $NO_x$ and CO emissions, or alternatively achieving low emissions with fuels comprising as little as 0% $H_2$. The invention also relates to burners which are resistant to plugging and provide high flame stability.

BACKGROUND OF THE INVENTION

Industrial burners are commonly used in process heaters, boilers, furnaces, incinerators, and other fired-heating systems to produce heat for petroleum refining, chemical production, petrochemical operations, and other large-scale industrial processes.

With the global push to reduce carbon dioxide ($CO_2$) emissions, an interest has arisen in burning fuels in industrial fired-heating systems which consist solely of hydrogen ($H_2$) or at least compromise a high level of $H_2$, which is a zero-carbon fuel. Unfortunately, however, the adiabatic flame temperature produced when burning 100% $H_2$ or other high hydrogen fuel is significantly greater than the flame temperatures produced when burning methane, natural gas, or other common fuel gas compositions.

Other conditions being equal, $NO_x$ emissions increase as the temperature of the combustion process increases. As the temperature of the burner flame increases, the stability of the covalent bond of the $N_2$ in the burner air supply decreases, causing increased production of free nitrogen and thus also increasing the production of thermal $NO_x$ emissions. Consequently, in an ongoing effort to reduce $NO_x$ emissions, various types of burner designs and theories have been developed with the objective of reducing the peak flame temperature.

Thermal $NO_x$ reduction is generally achieved by slowing the rate of combustion, e.g., by staged air or staged fuel operation and/or dilution of the combustion mixture with inert flue gas. Since the combustion process is a reaction between oxygen and the burner fuel, the objective of delayed combustion is typically to reduce the rate at which the fuel and oxygen mix together and burn. The faster the oxygen and the fuel mix together and burn, the faster the rate of combustion and the higher the peak flame temperature.

One type of low $NO_x$ burner which is very effective for slowing the rate of combustion and reducing peak flame temperatures is a free-jet burner. A free jet burner will typically comprise: (i) a burner wall, (ii) an interior passageway for delivering a flow of air or other oxygen-containing gas out of the forward end of the burner wall, and (iii) a series of outer ejectors positioned to discharge fuel streams in free jet flow outside of the burner wall to the burner flame. The flow momentum of the free jet streams traveling outside of the burner wall entrains a significant amount of the gaseous products of combustion (flue gas) contained in the fired-heating system, thereby recirculating the flue gas back into the combustion zone to form a diluted combustion mixture which burns at a lower peak flame temperature. This $NO_x$ reduction technique is referred to as Internal Flue Gas Recirculation (IFGR).

In addition to the above, the processing units in today's refineries, chemical plants, and other facilities must be capable of operating for increasingly longer periods of time without the need to shut down for major repairs and maintenance. In fact, the maintenance cycles in many refineries and other facilities are now up to four years, or longer. Consequently, the continued, reliable operation of burners and other critical equipment for very long periods of time is also becoming increasingly important.

One of the main causes of down time for industrial burners occurs when the fuel ports of the burner tips become plugged with debris or residue. The plugging of the fuel ports can lead to reduced or blocked fuel gas flow.

Unfortunately, as improved free jet burners have been developed which provide lower and lower levels of $NO_x$ emissions, the plugging resistance of these burners generally has not improved. Rather, in some cases, the plugging resistance of the burners has deteriorated to some degree. One reason is that greater amounts of flue gas recirculation, further reductions in $NO_x$ emissions, and greater stability have often been achieved by using a greater number of outer ejectors, having very small ejection ports (typically only $1/16^{th}$ inch in diameter), which are placed close together (i.e., less than 2 inches apart and more preferably only 1.5 to 1.8 inches apart). The small ejection ports are necessary for preventing interference between the adjacent fuel flow streams and facilitating flue gas entrainment.

However, the small ejection ports used in the prior low-$NO_x$ free-jet burners have been prone to plugging by tiny debris and/or limited buildup. Consequently, fuel strainers are generally not effective for preventing plugging, particularly in systems which have high levels of debris due to the age of the fuel pipes and/or other factors.

The use of auxiliary burner tips in free-jet burners and in other burners has also been problematic in terms of both plugging and $NO_x$ emissions. An auxiliary burner tip is a gas tip which is used to enhance the stability of the main flame of a burner, particularly during upset conditions. Examples of upset conditions which can cause the burner flame to become unstable include but are not limited to: (a) a reduction in the air flow to the burner to a sub-stoichiometric level, (b) a loss of temperature in the fired-heating system to a level below the minimum temperature required for igniting the fuel, or (c) the occurrence of pressure excursions in the fired-heating system.

In the auxiliary burner tips currently used in the art, the speed of combustion and the peak flame temperature of the auxiliary tip are typically sufficiently high that the use of one or more auxiliary tips can significantly increase the $NO_x$ emissions produced by the burner. Moreover, the auxiliary tips currently used in the art are particularly susceptible to plugging. Because the fuel gas ports of these auxiliary tips are very small, typically $1/16^{th}$ inch in diameter (i.e., a port flow area of only 0.0031 $in^2$) the tips are prone to plugging, even after filtration.

If plugging occurs in an auxiliary burner tip which is responsible for maintaining the stability of the burner flame, the localized temperature at the stability point can be reduced until the stability of the flame can no longer be maintained and the flame is lost. When a loss of flame occurs in one or more burners of a multi-burner heating system, significant safety concerns can arise, including the risk of an explosion.

Consequently, a need exists for an improved free-jet burner which (a) produces little or no $CO_2$ emissions, (b) produces Ultra-Low $NO_x$ emissions and low levels of other emissions which are comparable to, or better than, the Ultra-Low emissions levels of the free jet burners currently used in the art, (c) is more resistant to plugging, and (d) provides a high degree of flame stability.

SUMMARY OF THE INVENTION

The present invention provides a free-jet burner, and method of operation, which satisfy the needs and alleviate the problems discussed above. The inventive burner and method allow the use of up to 100% hydrogen fuel to provide very low $CO_2$ emissions, while also providing Ultra-Low $NO_x$ emissions and very low CO emissions. In addition, the inventive burner and method also provide ultra-low $NO_x$ emissions and very low CO emissions when burning natural gas and/or other fuels with as little as 0% hydrogen. The inventive burner is also highly resistant to plugging and provides a high degree of flame stability. Further, because there is no pre-mixing of the fuel and air in the inventive burner, there is no possibility of flashback, even when the fuel is 100% $H_2$.

When operating with 100% $H_2$ and 2% excess dry oxygen with multiple burners at a furnace temperature of 1,580° F., the inventive burner and method provide $CO_2$ emissions of 0 ppmv added to the atmosphere (at an atmospheric $CO_2$ concentration of 417 ppmv).

When operating with 100% natural gas fuel and 2% excess dry oxygen with multiple burners at a furnace temperature of 1,380° F., the inventive burner and method (a) provide $NO_x$ emissions of less than 7 ppmv and down to 5.2 ppmv or less when optimized and (b) provide CO emissions of not more than 5 ppmv and down to 0 ppmv when optimized.

When operating with 100% natural gas fuel and 8.6% excess dry oxygen with multiple burners at a low furnace temperature of 944° F., the inventive burner and method still provide (a) $NO_x$ emissions of less than 11 ppmv and down to 9 ppmv or less when optimized and (b) CO emissions of not more than 550 ppmv and down 450 ppmv or less when optimized.

When operating with 100% natural gas fuel and 13.8% excess dry oxygen with multiple burners at a low furnace temperature of 842° F., the inventive burner and method still provide (a) $NO_x$ emissions of less than 12 ppmv and down to 10 ppmv or less when optimized and (b) CO emissions of not more than 120 ppmv and down 80 ppmv or less when optimized.

In one aspect, there is provided a burner for providing low emissions in a heating system having a flue gas therein. The burner preferably comprises: (i) a burner wall having a longitudinal axis and a forward end; (ii) an interior passageway of the burner wall for a flow of air or other oxygen-containing gas out of the forward end of the burner wall; (iii) the forward end of the burner wall having a surrounding outer perimeter which measures a total of from 32 to 240 inches around the longitudinal axis of the burner wall; (iv) a series of ejector tips spaced around the longitudinal axis of the burner wall, the total number of the ejector tips of the series being not less than three and not more than six and the ejector tips of the series being positioned longitudinally rearward and laterally outward with respect to the surrounding outer perimeter of the forward end of the burner wall; and (v) each of the ejector tips of the series comprising one or more fuel ejection ports which is/are oriented to eject a fuel stream in free-jet flow toward the surrounding outer perimeter of the forward end of the burner wall and/or toward a location on the burner wall which is different from the surrounding outer perimeter of the forward end of the burner wall.

In another aspect, the burner can further comprise: (vi) the one or more fuel ejection ports of each of the ejector tips of the series comprising a center ejection port, a right ejection port, and a left ejection port; (vii) the fuel stream ejected from the center ejection port of each of the ejector tips of the series being a center fuel stream, the fuel stream ejected from the right ejection port of each of the ejector tips of the series being a right fuel stream, and the fuel stream ejected from the left ejection port of each of the ejector tips of the series being a left fuel stream; and (viii) for each of the ejector tips of the series, the center ejection port also being oriented to eject the center fuel stream toward the longitudinal axis, the right ejection port also being oriented to eject the right fuel stream at an angle away from the center fuel stream on a right side of the center fuel stream, and the left ejection port also being oriented to eject the left fuel stream at an angle away from the center fuel stream on a left side of the center fuel stream.

In another aspect, the burner can further comprise for each of the ejector tips of the series, the distance along the surrounding outer perimeter of the forward end of the burner wall from (a) a lateral midpoint of the right fuel stream at the surrounding outer perimeter of the forward end of the burner wall to (b) a lateral midpoint of the left fuel stream at the surrounding outer perimeter of the forward end of the burner wall being equal to from one eighth to one third of the surrounding perimeter of the forward end of the burner wall.

In another aspect, there is provided a method of operating a burner for low emissions in a heating system having a flue gas therein. The method preferably comprises the steps of: (a) providing a burner in the heating system, the burner comprising a burner wall having a longitudinal axis, a forward end, and an interior passageway through which a stream of air or other oxygen-containing gas flows out of the forward end of the burner wall, the forward end of the burner wall having a surrounding outer perimeter which measures a total of from 32 to 240 inches around the longitudinal axis of the burner wall and (b) ejecting a fuel from a series of ejector tips spaced around the longitudinal axis of the burner wall, the total number of the ejector tips of the series being not less than three and not more than six, the ejector tips of the series being positioned longitudinally rearward and laterally outward with respect to the surrounding outer perimeter of the forward end of the burner wall, and each of the ejector tips of the series comprising one or more fuel ejection ports which each eject a stream of the fuel in free jet flow toward the surrounding outer perimeter of the forward end of the burner wall and/or toward a location on the burner wall which is different from the surrounding outer perimeter of the forward end of the burner wall.

In another aspect, the method can further comprise: (i) the one or more fuel ejection ports of each of the ejector tips of the series comprising a center ejection port, a right ejection port, and a left ejection port; (ii) the stream of the fuel ejected from the center ejection port of each of the ejector tips of the series being a center fuel stream, the stream of the fuel ejected from the right ejection port of each of the ejector tips of the series being a right fuel stream, and the stream of the fuel ejected from the left ejection port of each of the ejector tips of the series being a left fuel stream; and (iii) for each of the ejector tips of the series, the center fuel stream being ejected toward the longitudinal axis, the right fuel stream being ejected at an angle away from the center fuel stream on a right side of the center fuel stream, and the left fuel stream being ejected at an angle away from the center fuel stream on a left side of the center fuel stream.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
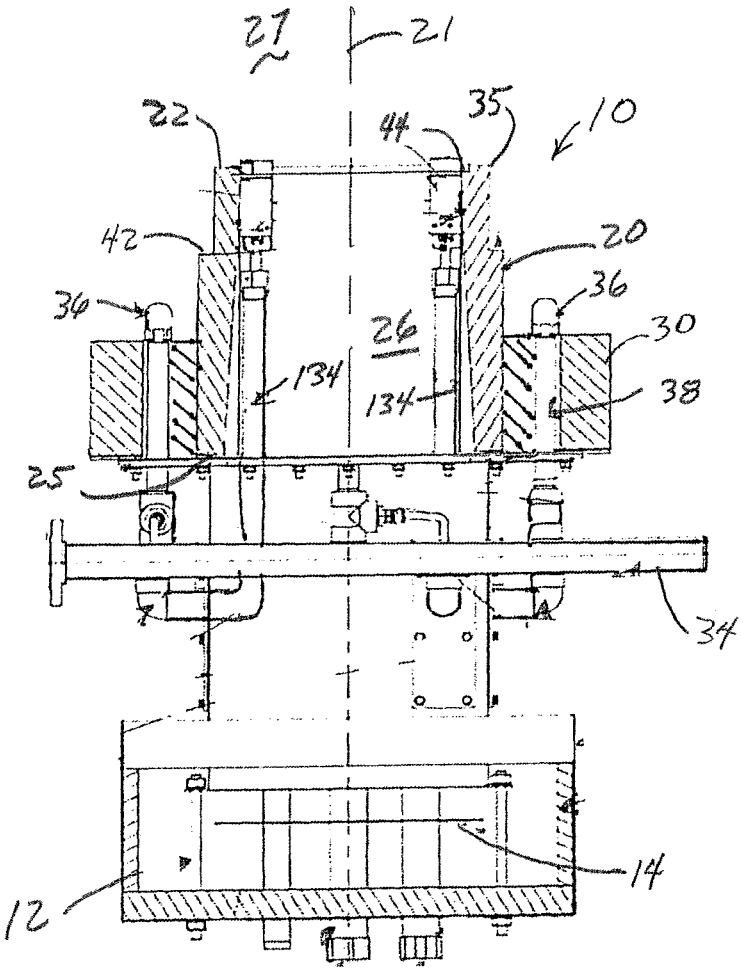
FIG. 1 is a cutaway elevational side view of an embodiment 10 of the burner provided by the present invention.
Figure 2:
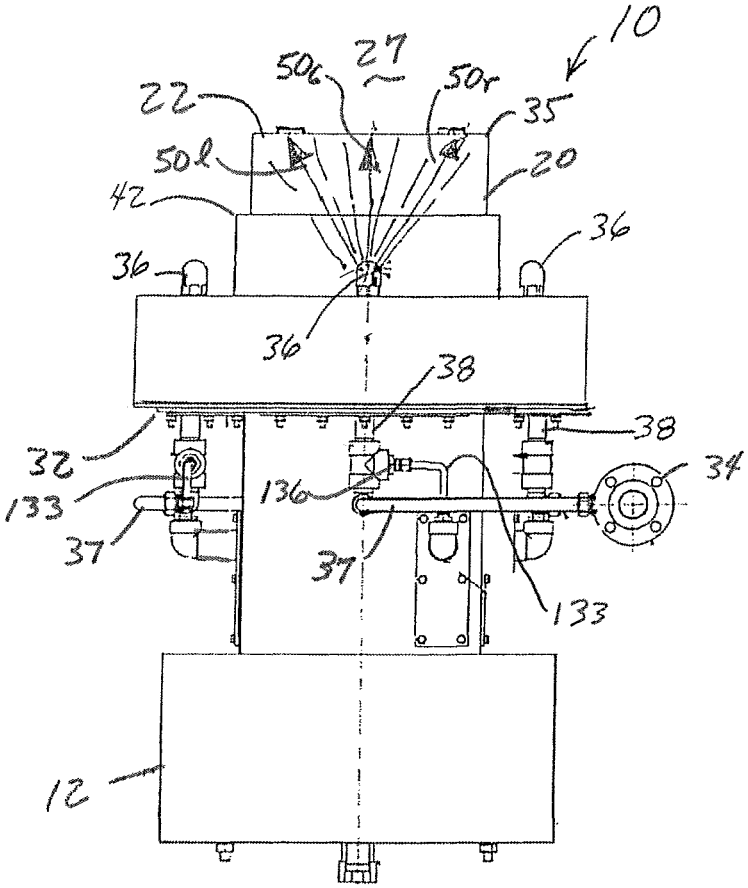
FIG. 2 is an elevational side view of the inventive burner 10.
Figure 3:
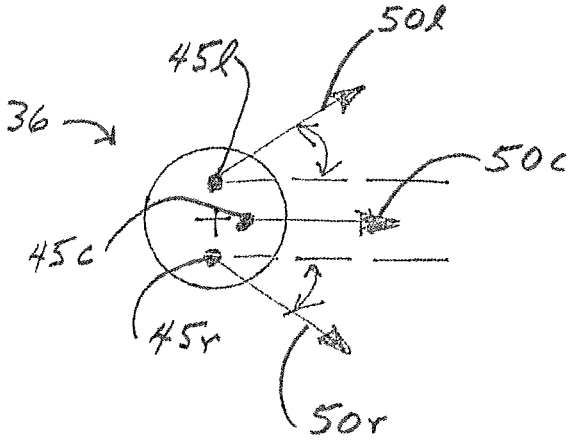
FIG. 3 is a top view of an ejector tip 36 used in the inventive burner 10.
Figure 4:
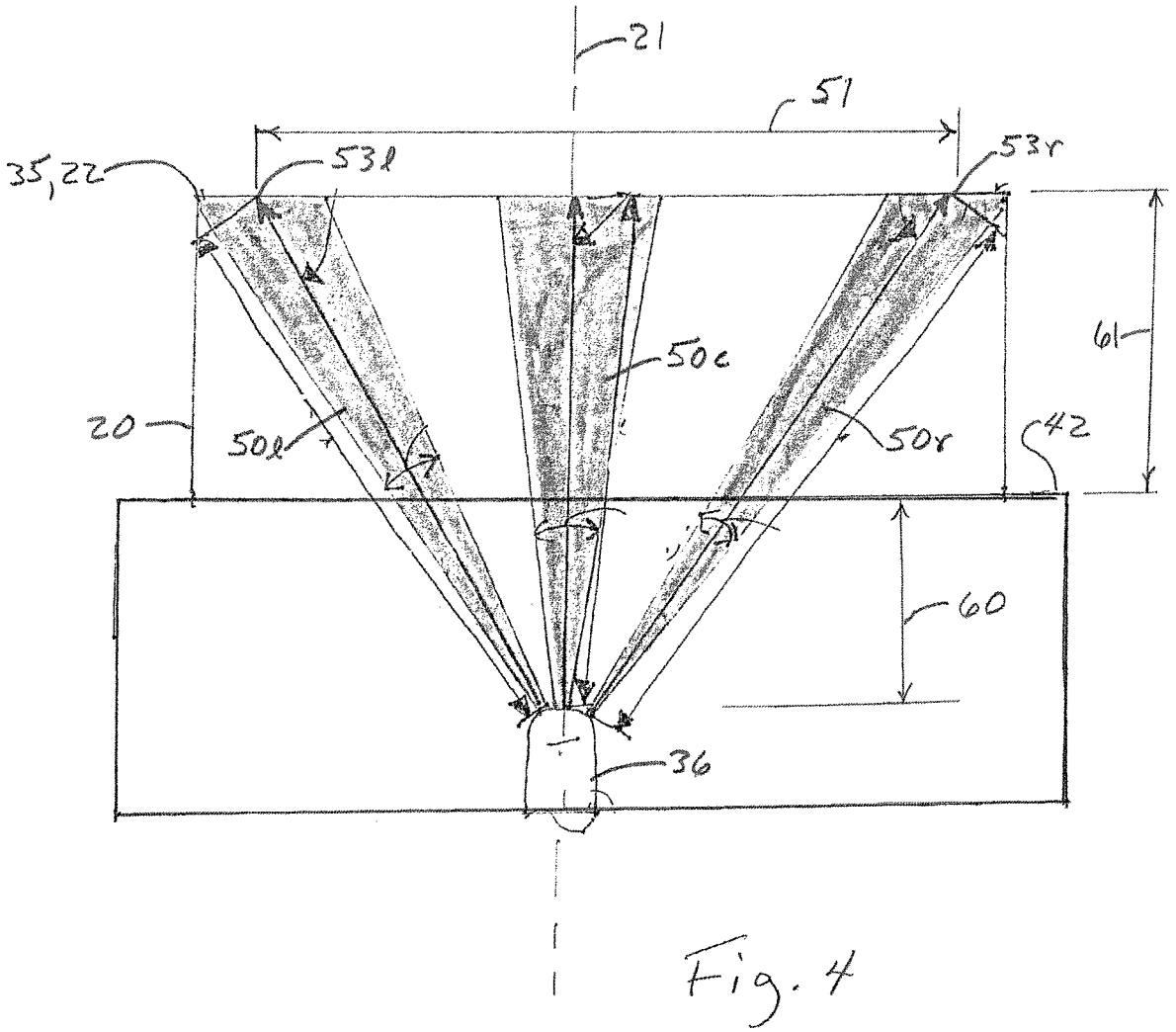
FIG. 4 schematically illustrates the ejection of a center fuel stream 50*c*, a right fuel stream 50*r*, and a left fuel stream 50*l* by the ejector tip 36.
Figure 5:
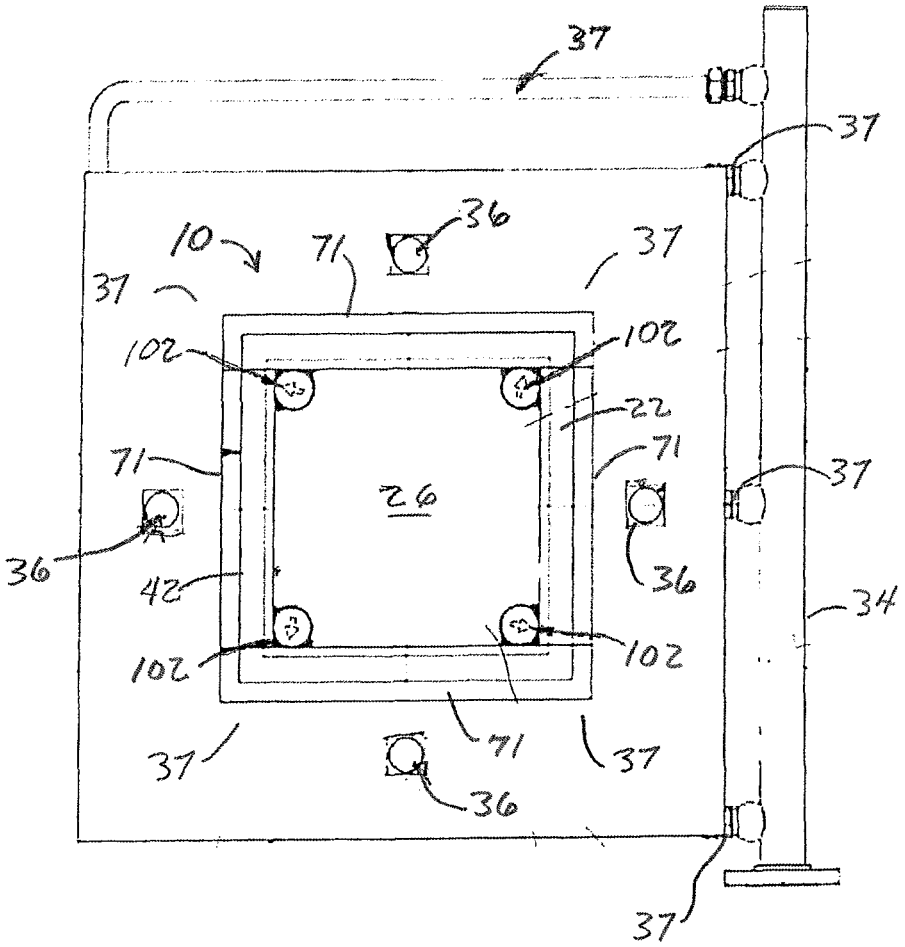
FIG. 5 is a top view of an embodiment of the inventive burner 10 having a square burner wall 20.
Figure 6:
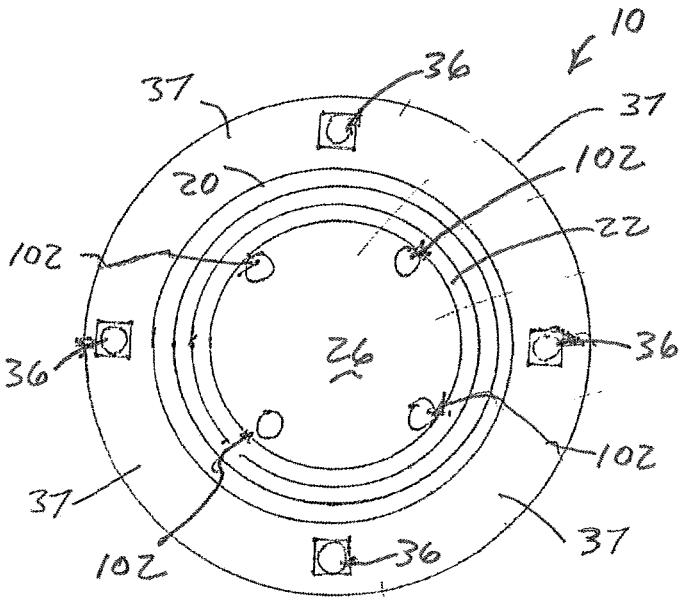
FIG. 6 is a top view of an embodiment of the inventive burner 10 having a circular burner wall 20.

Before explaining the present invention in detail, it is important to understand that the invention is not limited in its application to the details of the preferred embodiments and steps described herein. The invention is capable of other embodiments and of being practiced or carried out in a variety of ways. It is also to be understood that the phraseology and terminology employed herein are for the purpose of description and not of limitation.

As will be understood by those skilled in the art, the term "free-jet," as used herein and in the claims, refers to a flow issuing from an ejection port into a fluid which, compared to the flow, is more at rest. In the present invention, the fluid issuing from the ejection port can be a gas burner fuel and/or a liquid burner fuel, but is preferably a gas fuel, and the fluid substantially at rest is the flue gas present within a fired-heating system. For purposes of the present invention, the fired-heating system can be a process heater, a boiler, or generally any other type of fired-heating system used in the art. The flue gas present within the system will comprise the gaseous products of the combustion process.

In order to minimize $CO_2$ emissions, the fuel used in the inventive burner and method will preferably be 100% hydrogen or a high hydrogen gas fuel comprising at least 30%, at least 40%, at least 50%, at least 60%, at least 70%, at least 80%, or at least 90% $H_2$. Alternatively, the inventive burner and method also allow the use of low $H_2$ or no $H_2$ gas or liquid fuels while continuing to provide ultra-low $NO_x$ emissions. Examples of alternative fuels include, but are not limited to natural gas, refinery fuel gas, or generally any other type of gas fuel or gas fuel blend employed in process heaters, boilers, or other fired-heating systems. The free-jet flow employed in the inventive system operates to entrain flue gas and to thoroughly mix the flue gas with each fuel stream as it travels to the burner flame.

An embodiment 10 of the inventive burner apparatus is illustrated in FIGS. 1-8. Burner 10 comprises a housing 12 and a burner wall 20. The burner wall 20 has a longitudinal axis 21, an outlet or forward longitudinal end 22, a base end 25, and an interior throat or other passageway 26 which extends through and is surrounded by the burner wall 20. The outlet end 22 of the burner wall 20 is in communication with the interior 27 of a furnace or other fired-heating system in which the combustion process takes place, and which therefore contains the gaseous products (i.e., the flue gas) produced by the combustion process. Burner 10 is shown as installed through the floor or other wall 32 of the fired-heating system, which is typically formed of metal. Insulating material 30 will typically be secured to the interior of the furnace floor or wall 32.

The burner wall 20 is preferably constructed of a high temperature refractory burner tile material. However, it will be understood that the burner wall 20 can alternatively be formed of, or provided by, a metal band, a refractory band, or any other material or structure which is capable of (a) providing an acceptable flow passageway for air or other oxygen-containing gas into the heating system enclosure 27 and (b) withstanding the high temperature conditions therein.

Combustion air or other oxygen-containing gas 28 is received in housing 12 and directed by the housing 12 into the inlet end 24 of burner throat 26. The air or other oxygen-containing gas 28 is discharged from the forward end 22 of the burner wall 20 into a flame region 29 of the burner 10. The quantity of combustion air or other oxygen-containing gas entering the housing 12 is regulated by inlet damper 14. The air or other oxygen-containing gas 28 can be provided to housing 12 as necessary by forced circulation, natural draft, a combination thereof, or in any other manner employed in the art.

The size of the inventive burner 10 can vary significantly depending upon the intended use. The surrounding outer perimeter 35 of the forward end 22 of the burner wall 20 will preferably measure in the range of from 32 to 240 inches, more preferably from 48 to 144 inches, around the longitudinal axis 21 of the burner wall 20.

The burner 10 comprises a series, preferably only a single series, of ejector tips 36 which are spaced around the longitudinal axis 21 of the burner wall 20 outside of the interior passageway 26 of the burner wall 20. The total number of ejector tips 36 in the series of ejectors is preferably in the range of from three to six ejector tips 36, most preferably four ejector tips 36, which are evenly spaced around the longitudinal axis 21. Each ejector tip 36 is secured on the forward end of a fuel riser 38. For each of the ejector tips 36, the fuel riser 38 for the ejector tip 36 is or is part of a main fuel line 37 which is in communication with a burner fuel supply manifold 34 to deliver hydrogen and/or other fuel to the ejector tip 36.

The fuel riser 38 for each ejector tip 36 will typically either extend through a lower skirt portion of the burner tile or be affixed within the insulating material 30 attached to furnace wall 32. The length and locations of fuel risers 38 for the ejector tips 36 are such that the ejector tips 36 are positioned longitudinally rearward (preferably in proximity to the base 25 of the burner wall 20) and laterally outward with respect to the surrounding outer perimeter 35 of the forward end 22 of the burner wall 20 so that the free jet fuel streams discharged by the ejector tips 36 travel outside of the burner wall 20 through the flue gas in the fired-heating system 27 on their way to the flame region 29.

Each of the ejector tips 36 has one or more fuel ejection ports drilled or otherwise formed therein which is/are oriented to eject a stream of the fuel in free-jet flow forwardly and inwardly toward the surrounding outer perimeter 35 of the forward end 22 of the burner wall 20 and/or forwardly and inwardly toward a location on the burner wall 20 which is different from the surrounding outer perimeter 35 of the forward end 22 of the burner wall 20, e.g., toward one or more contacting ledges 42 which are formed around the burner wall 20 forwardly of the ejector tips 36 and rearwardly of the surrounding outer perimeter 35 of the forward end 22 of the burner wall 20.

Each ejector tip 36 preferably has a center ejection port 45*c*, a right ejection port 45*r*, and a left ejection port 45*l* drilled or otherwise formed therein. A center fuel stream 50*c* is ejected from the center ejection port 45*c*, a right fuel stream 50*r* is ejected from the right ejection port 45*r*, and a left fuel stream 50*l* is ejected from the left ejection port 45*l*.

As noted above, the center ejection port 45*c*, the right ejection port 45*r*, and the left ejection port 45*l* are each oriented to eject the center, right, and left fuel streams 50*c*, 50*r*, 50*l* toward the surrounding outer perimeter 35 of the forward end 22 of the burner wall 20 and/or toward a location on the burner wall 20 which is different from the surrounding outer perimeter 35 of the forward end 22 of the burner wall 20, e.g., toward one or more contacting ledges 42 which are formed around the burner wall 20 forwardly of the ejector tips 36 and rearwardly of the surrounding outer perimeter 35 of the forward end 22 of the burner wall 20.

In addition, in order to increase the contact and mixing of the fuel ejected from the tips 36 with the flue gas in the fire-heating system 27 and thereby increase the amount of internal flue gas recirculation (IFGR) with the fuel, the center ejection port 45*c* is preferably also oriented to eject the center fuel stream 50*c* toward the longitudinal axis 21 of the burner wall 20, the right ejection port 45*r* is preferably also oriented to eject the right fuel stream 50*r* at an angle away from the center fuel stream 50*c* on a right side of the center fuel stream 50*c*, and the left ejection port 45*l* is preferably also oriented to eject the left fuel stream 50*l* at an angle away from the center fuel stream 50*c* on a left side of the center fuel stream 50*c*.

Additionally, in order to further increase the amount of IFGR with the fuel ejected from the ejector tips 36, the outward ejection angles of the right and left fuel streams 50*r* and 50*l* of each of the tips 36 will preferably be such that the distance 51 along the surrounding outer perimeter 35 of the forward end 22 of the burner wall 20 from (i) the lateral midpoint 53*r* of the right fuel stream 50*r* where it contacts the surrounding outer perimeter 35 of the forward end 22 of the burner wall 20 to (ii) the lateral midpoint 531 of the left fuel stream 50*l* where it contacts the surrounding outer perimeter 35 of the forward end 22 of the burner wall 20 will be equal to from one eighth to one third of the surrounding outer perimeter 35 of the forward end 22 of the burner wall 20.

More preferably, when only four ejector tips 36 are included in the series of tips 36 spaced around the longitudinal axis 21 of the burner wall 20, the outward ejection angles of the right and left fuel streams 50*r* and 50*l* of each of the tips 36 will preferably be such that the distance 51 along the surrounding outer perimeter 35 of the forward end 22 of the burner wall 20 from (i) the lateral midpoint 53*r* of the right fuel stream 50*r* where it contacts the surrounding outer perimeter 35 of the forward end 22 of the burner wall 20 to (ii) the lateral midpoint 531 of the left fuel stream 50*l* where it contacts the surrounding outer perimeter 35 of the forward end 22 of the burner wall 20 will be equal to from one fifth to one third of the surrounding outer perimeter 35 of the forward end 22 of the burner wall 20.

In the inventive burner 10, the plugging resistance of the ejectors 36 is also increased by using large ejection ports 45*c*, 45*r*, and 45*l* in the ejector tips 36. The large fuel ports will preferably be drilled ports having a circular shape, but can alternatively be square, oval, or any other shape desired. The large fuel port 45*c*, 45*r*, and 45*l* of each ejector tip 36 will preferably have a flow area of at least 0.0068 $inch^2$ (i.e., a diameter of at least 3/32 inch for a circular port) and will more preferably have a flow area of at least 0.012 $inch^2$ (i.e., a diameter of at least $1/8^{th}$ inch for a circular port). The flow area of each of the large fuel ports 45*c*, 45*r*, and 45*l* will more preferably be in the range of from 0.012 to 0.096 $inch^2$ and will most preferably be about 0.012 $inch^2$ (i.e., a diameter of 1/8 inch for a circular port).

Also, in accordance with the improvements provided by the burner and method of the present invention, the wide spacing 37 between the ejector tips 36 (referred to herein as a wide tip-to-tip spacing) is used to enhance IFGR and make up for the reduction in IFGR which would otherwise occur as a result of using the larger, plugging resistant fuel ejection ports 45*c*, 45*r*, and 45*l*.

These improvements, i.e., using large fuel ejection ports 45*c*, 45*r*, and 45*l* and a wide tip-to-tip spacing 37 are counter to the conventional wisdom and the current practices in the industry for reducing $NO_x$ emissions and providing burner stability. As noted above, it is believed in the industry that $NO_x$ reductions and burner stability are best achieved by using a greater number of ejectors which have very small ejection ports of only $1/16^{th}$ inch in diameter and are positioned very close together at a tip-to-tip spacing of preferably not more than 4 inches.

In the inventive burner 10, the amount of flue gas which is recirculated to the combustion mixture for the main burner flame is enhanced and restored by using the wide tip-to-tip spacing 37 between the ejector tips 36, using a plurality of ejection ports 45*c*, 45*r*, and 45*l*, and ejecting the outer fuel streams 50*r* and 50*l* of each ejector tip 36 at outward angles. The increased tip-to-tip spacing 37 creates wider flow channels between the ejector tips 36 for the recirculation of the flue gas, which in turn enables the free-jet streams 50*c*, 50*r*, and 50*l* and the momentum of the air or other oxygen-containing gas to pull more flue gas into the combustion mixture. In addition, the use of multiple ejection ports in each tip 36 and the angular flow of the outer fuel streams 50*r* and 50*l* across the forward flow of the flue gas in the wide spaces 37 between the tips 36 provides further contact with and entrainment of the flue gas. As a result, the IFGR of the inventive burner 10 is substantially the same as or exceeds the amount of IFGR which is achieved in the prior free jet burners so that the peak flame temperature of the inventive burner 10 is reduced sufficiently to provide Ultra-Low $NO_x$ emissions even when burning up to 100% $H_2$.

However, although the inventive burner 10 provides resistance to plugging and enhanced IFGR, the use of one or more, preferably a plurality, of auxiliary burner tips 102 in the inventive burner 10 is also preferred in order to provide enhanced stability of the main burner flame, particularly during upset conditions. As mentioned above, a loss of stability can increase the chances of a burner flame-out if, for example, the burner experiences a significant reduction in air flow, or there is a significant loss of temperature in the heating system, or a pressure excursion occurs in the heating system. The potential for a loss of flame in one or more burners of a multiple burner heating system creates significant safety concerns, including the risk of an explosion.

Unfortunately, as also mentioned above, the auxiliary burners heretofore used by in the art for improved stability were themselves prone to plugging, which also presented a serious flame-out risk. In addition, the level of $NO_x$ emissions produce by the prior auxiliary burner tips was not satisfactory.

In accordance with the improved burner and method of the present invention, the need for ensuring the continued stability of the main burner flame is met by using one or more auxiliary burner tips 102 positioned in the internal passageway 26, of the burner wall 20, which are resistant to plugging and therefore do not themselves present a flame-out risk. Moreover, unlike the prior auxiliary burner tips, each of the inventive auxiliary burner tips 102 used in the inventive burner and method produces a very low level of $NO_x$ emissions which does not contribute significantly to the total emissions of the inventive burner 10.

To prevent plugging, each auxiliary burner tip 102 used in the inventive burner 10 has a large fuel discharge port 132 which preferably has a flow area of at least 0.012 $inch^2$ (i.e., a diameter of at least ⅛ inch for a circular port) and more preferably has a flow area of at least 0.049 $inch^2$ (i.e., a diameter of at least $1/4^{th}$ inch for a circular port). The flow area of the large fuel discharge port 132 will more preferably be in the range of from 0.049 to 0.06 $inch^2$ and will most preferably be about 0.049 $inch^2$. Also, in order to provide low levels of $NO_x$ emissions, each auxiliary burner tip 102 is preferably either a sub-stoichiometric, staged air burner tip or a lean pre-mix burner tip.

The number of auxiliary tips 102 used in the inventive burner 10 can be any number suitable for maintaining the stability of the burner flame 46, particularly when subjected to upset conditions of the type described above. The number of the auxiliary burner tips 102 used in the inventive burner 10 will more preferably be equal to the total number of main free jet burner tips 36 of the burner 10.

Figure 9:
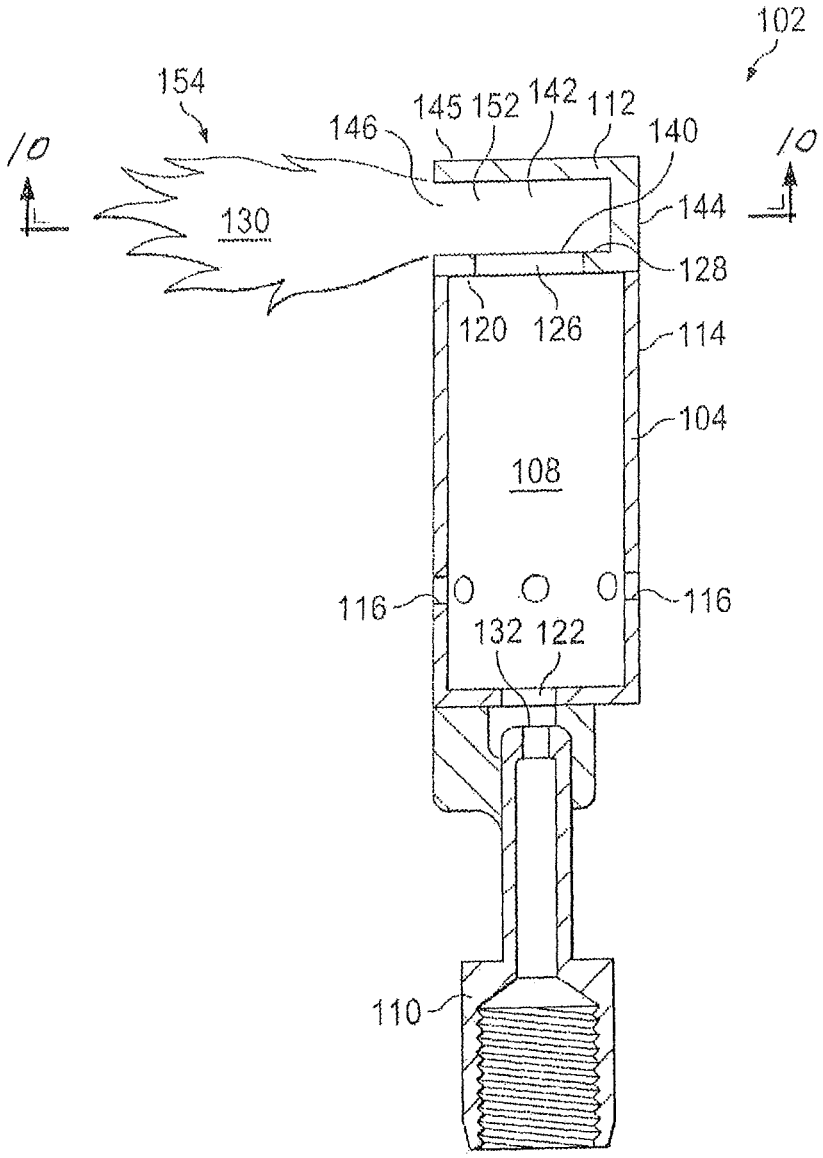
FIG. 9 is a cutaway elevational side view of an embodiment 102 of an auxiliary burner tip used in the inventive burner 10.
Figure 10:
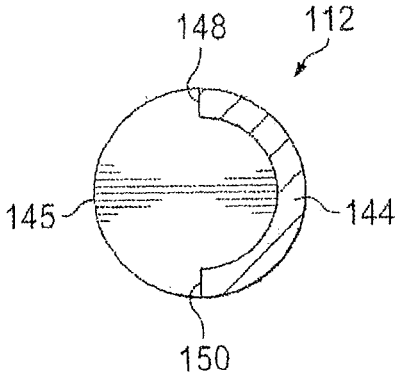
FIG. 10 is a cutaway view of the auxiliary burner tip 102 as seen from perspective 10-10 shown in FIG. 9.
Figure 11:
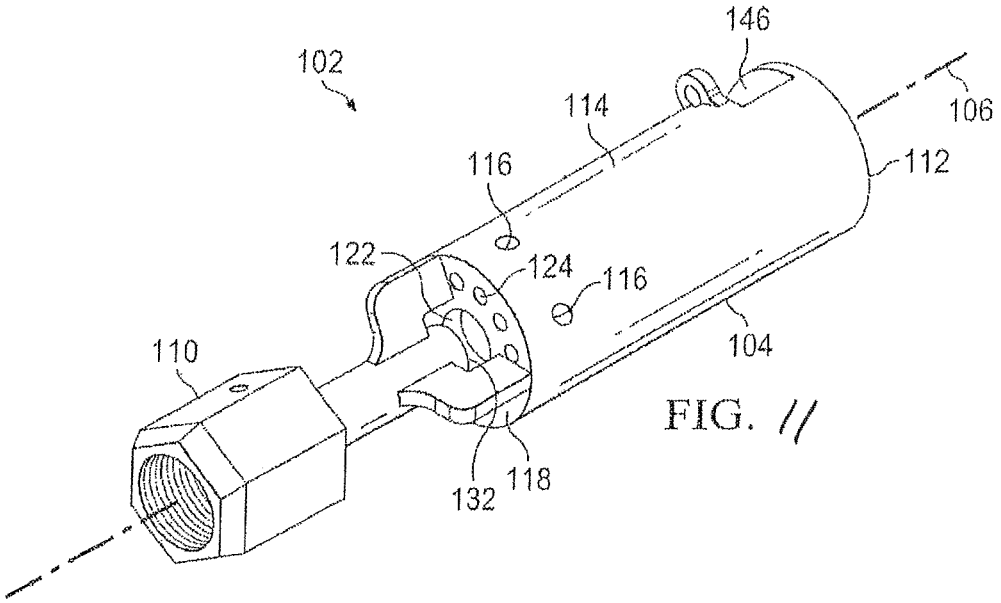
FIG. 11 is a perspective view of the auxiliary burner tip 102.

Each auxiliary burner tip 120 used in the inventive burner and method is preferably a staged air, sub-stoichiometric burner tip as illustrated in FIGS. 9-11. The auxiliary burner tip 102 preferably comprises: a tip shield housing 104 having a longitudinal axis 106; a mixing chamber 108 contained within the shield housing 104; a gas fuel spud 110 positioned to discharge a gas fuel into the rearward longitudinal end of the mixing chamber 108; and a flame diverter 112 on the forward longitudinal end of the shield housing 104.

The tip shield housing 104 preferably comprises a longitudinally extending outer wall 114 which surrounds the mixing chamber 108. The outer wall 114 is preferably cylindrical but can alternatively have a square, oval, or other cross-sectional shape. A series of small openings 116 is preferably provided around and through a rearward portion of the outer wall 114 to serve as contingency relief openings for gas expansion in the event that combustion occurs within the shield housing 104 itself.

The lateral base wall 118 at the rearward end of the mixing chamber 108 has at least a central opening 122 provided therethrough. As the gas fuel is discharged into the rearward end of the mixing chamber 108 by the gas fuel spud 110, the momentum of the gas fuel stream draws air or other oxygen-containing gas, from the interior passageway 26 of the burner 10, into the mixing chamber 108 through the central base opening 122. In addition, the momentum of the gas fuel preferably also draws air or other oxygen-containing gas into the mixing chamber 108 through a plurality of openings 124 which are formed through the base wall 118 of the shield housing 104 around the central base opening 122. The surrounding openings 124 are preferably smaller that the central base opening 122. The base openings 122 and 124 are preferably sized such that the total amount of air or other oxygen-containing gas which is drawn into the mixing chamber 108 is a sub-stoichiometric amount, i.e., an amount which is not sufficient for burning all of the gas fuel which is discharged into the mixing chamber 108 by the gas fuel spud 110.

The flame stabilization ring 120 at the forward end of the mixing chamber 108 has a central discharge opening 126 provided therethrough which is smaller than the cross-sectional diameter or area of the mixing chamber 108 so that the flow of the sub-stoichiometric mixture of fuel and oxygen-containing gas from the mixing chamber 108 through the flame stabilization ring 120 creates a reduced pressure area 128 on or near the stabilization ring 120 which assists in holding and otherwise stabilizing the flame 130 of the auxiliary tip 102.

The gas fuel spud 110 includes the large fuel discharge port 132 at the forward end thereof for discharging the gas fuel into the rearward longitudinal end of the mixing chamber 108. The fuel discharge port 132 of the spud 10 is preferably positioned rearwardly of the base wall 118 of the shield housing 104 so that the spud 110 discharges the gas fuel forwardly through the central opening 122 of the base wall 118. The fuel discharge port 132 can be formed directly in the forward end of the gas fuel spud 110 or can be formed in an orifice plug which is placed in the forward end of the spud 110.

In addition to the use of the large discharge port 132, the gas fuel spud 110 of each auxiliary burner tip 102 is preferably connected to an auxiliary fuel line 133. The auxiliary fuel line 133 includes an auxiliary fuel riser 134 which extends forwardly in the interior passageway 26 of the burner wall 22 to the auxiliary burner tip 102. The auxiliary fuel line 133 also has an orifice union 136 therein which contains a flow orifice.

The auxiliary fuel line 133 of each auxiliary burner tip 102 is preferably connected to, and preferably extends to the auxiliary burner tip 102 from, the main fuel line 37 of a separate one of the ejector tips 36.

The flow area of the flow orifice (a) is preferably at least 0.0068 $inch^2$ (which is equivalent to a circular orifice diameter of at least 3/32 inch) and will more preferably be at least 0.012 $inch^2$ (which is equivalent to a circular orifice diameter of at least ⅛ inch) but (b) is also preferably less than the size of the fuel spud discharge port 132. The flow area of the flow orifice will more preferably be in the range of from 0.012 $inch^2$ to about 0.014 $inch^2$ and will most preferably be about 0.012 $inch^2$. In the event that the system contains any debris of sufficient size to plug the large discharge port 132 of the gas fuel spud 110, the debris will be stopped by the flow orifice in the orifice union 136, which will preferably be positioned outside of the fired-heating system so that it can be cleaned without shutting down the fired-heating system. The flow orifice can also be used to meter the rate of flow of the gas fuel to the auxiliary burner tip 102 from the external fuel supply manifold 34.

The flame diverter 112 on the forward longitudinal end of the shield housing 104 preferably comprises: a rearward opening 140; an interior flame space 142; a longitudinally extending side wall 144 which extends partially around the interior flame space 142; an end wall 145 at the forward longitudinal end of the side wall 144; and a lateral side opening 146. The end wall 145 is preferably a solid circular end wall which extends laterally over and covers the interior flame space 142. The longitudinally extending side wall 144 of the flame diverter 112 has a semicircular lateral cross-sectional shape which extends from a first arc end point 148 to a second arc end point 150. The semicircular cross-sectional shape of the longitudinally extending side wall 144 is preferably an arc in the range of from 120° to 270° which extends from the first arc end point 148 to the second arc end point 150 and is more preferably an arc of about 180°.

The lateral side opening 146 of the flame diverter 112 preferably (a) extends from the first arc end point 148 to the second arc end point 150 of the side wall 144 in the lateral cross-sectional plane and (b) extends longitudinally from the lateral flame stabilization ring 120 to the end wall 145 of the flame diverter 112. The lateral side opening 146 is preferably oriented to discharge the flame 130 of the auxiliary burner tip 102 laterally outward at an angle which is in the range of from 60° to 120°, more preferable about 90°, with respect to the longitudinal axis 106 of the tip shield housing 104.

In order to maintain the stability of the main burner flame, the flame diverter 112 preferably diverts and directs the auxiliary tip flame 130 laterally outward onto (a) the forward end 22 of the burner wall 20, (b) an internal ledge, shoulder or other internal feature 44 of the burner wall 20, or (c) any other stability point of the burner 10. Moreover, the diversion of the auxiliary tip flame 130 by the flame diverter 112 advantageously provides a staged air operating regime for the sub-stoichiometric auxiliary tip 102 which reduces the $NO_x$ emissions produced by the auxiliary tip 102.

In the staged air operation of the auxiliary burner tip 102, the sub-stoichiometric, fuel rich, mixture of gas fuel and oxygen-containing gas (preferably air) flowing out of the forward end of the mixing chamber 108 begins combustion in a sub-stoichiometric combustion region 152, which includes the interior flame space 142 of the flame diverter 112. Next, the auxiliary tip flame 130 is diverted laterally into the air or other oxygen-containing gas flowing through the interior passageway 26 of the inventive burner 10, outside of the auxiliary burner tip 102. The diversion of the auxiliary tip flame 130 into the flow of air, or other oxygen-containing gas, creates a fuel lean combustion region 154, outside of the auxiliary tip 2, in which the remaining portion of the gas fuel which was not combusted in the sub-stoichiometric combustion zone 152 of the auxiliary tip 102 is burned.

The staged air operation provided by combusting a first portion of the auxiliary tip fuel in the sub-stoichiometric flame region 152 followed by combustion of the remainder of the fuel in the fuel lean flame region 154 reduces the peak temperature of the auxiliary tip flame 130 in both regions and thereby reduces the levels of $NO_x$ and other emissions produced by the auxiliary tip 102.

It will be understood that, however, that in some forced draft applications, the operation of the auxiliary tip 102 will be lean with high localized excess air, depending upon the combustion air pressure drop through the burner 102.

Although the inventive burner 10 is illustrated in the drawings as being in a vertical orientation, it will be understood that the burner 10 can alternatively be oriented downwardly, horizontally, or at any other desired angle. In addition, although various elements and features of the inventive burner 10 are shown and may be described as having cylindrical or circular shapes, it will be understood that these elements and features can alternatively be square or oval in shape, or can be of any other shape desired.

The burner wall 20 of inventive burner 10 can be circular, square, rectangular; or generally any other desired shape. The surrounding outer perimeter 35 of the forward end 22 of the burner wall will preferably be either square or circular. The square burner 10 will preferably have four ejector tips 36 and four offset auxiliary tips 102 wherein (a) one ejector tip 36 is centered outside of each side 71 of the square burner wall 20 and (b) one of the auxiliary burner tips 102 is positioned in each corner of the square interior passageway 26 of the burner wall 20. The circular burner 10 will preferably have (a) four ejector tips 36 spaced 90° apart outside of the circular burner wall 20 and (b) four auxiliary burner tips 102 which are spaced 90° apart in the circular interior passageway 26 of the burner wall 10 such that the inside auxiliary burner tips 102 are offset 45° from the outside ejector tips 36.

To further facilitate the entrainment and mixing of flue gas with the fuel jet flow streams, the inventive burner 10 preferably comprises one or more exterior impact structures 42 which is/are longitudinally positioned forwardly of the ejector tips 36 and rearwardly of the forward end 22 of the burner wall 20. The exterior impact structures are preferably positioned at least partially within the paths of some or all of the free jet fuel streams 50*c*, 50*r*, and/or 50*l*. Each such impact structure 42 can generally be any type of obstruction which will decrease the flow momentum and/or increase the turbulence of the fuel streams 50*c*, 50*r*, and/or 50*l* sufficiently to promote flue gas entrainment and mixing while allowing the resulting mixture to flow on to the main burner flame.

Although other types of impact structures 42 can be employed, the impact structure(s) 42 used in the inventive burner 10 will most preferably be one or more tiered ledges or other features of a type which can be conveniently formed in a poured refractory as part of and/or along with the burner wall 20. In addition, although a single impact ledge 42 is shown in the drawings, it will be understood that the inventive burner 10 can have up to as many as six tiered ledges 42 or more.

Depending upon the characteristics and size of the heating system in which the inventive burner 10 is used, and the amount of heat output required, the size and dimensions of the burner 10 can range significantly. As noted above, depending upon the application, the size of the inventive burner 10 will preferably be such that the surrounding outer perimeter 35 of the forward end 22 of the burner wall 20 measures a total of from 32 to 240 inches around the longitudinal axis 21 of the burner wall 20. The amount of flue gas which mixes with the fuel streams 50*c*, 50*r*, and 50*l* ejected from the ejector tips 36 also increases as the distance from the ejector tips 36 to the forward end 22 of the burner wall 20 and/or to each intermediate ledge 42 increases.

The longitudinal height 60 of the tiered ledge 42 of the burner wall 20 above the ejector tips 36 will generally be in the range of from 1 to 18 inches or more and will more preferably be in the range of from 2 to 10 inches. The longitudinal height of any additional intermediate tiered ledge will generally be in the range of from 1 to 16 inches or more and will more preferably be in the range of from 2 to 10 inches above the preceding intermediate ledge. The longitudinal height 61 of the surrounding outer perimeter 35 of the forward end 22 of the burner wall 20 will generally be in the range of from 1 to 18 inches or more and will more preferably be in the range of from 2 to 10 inches above the preceding intermediate ledge 42.

Figure 7:
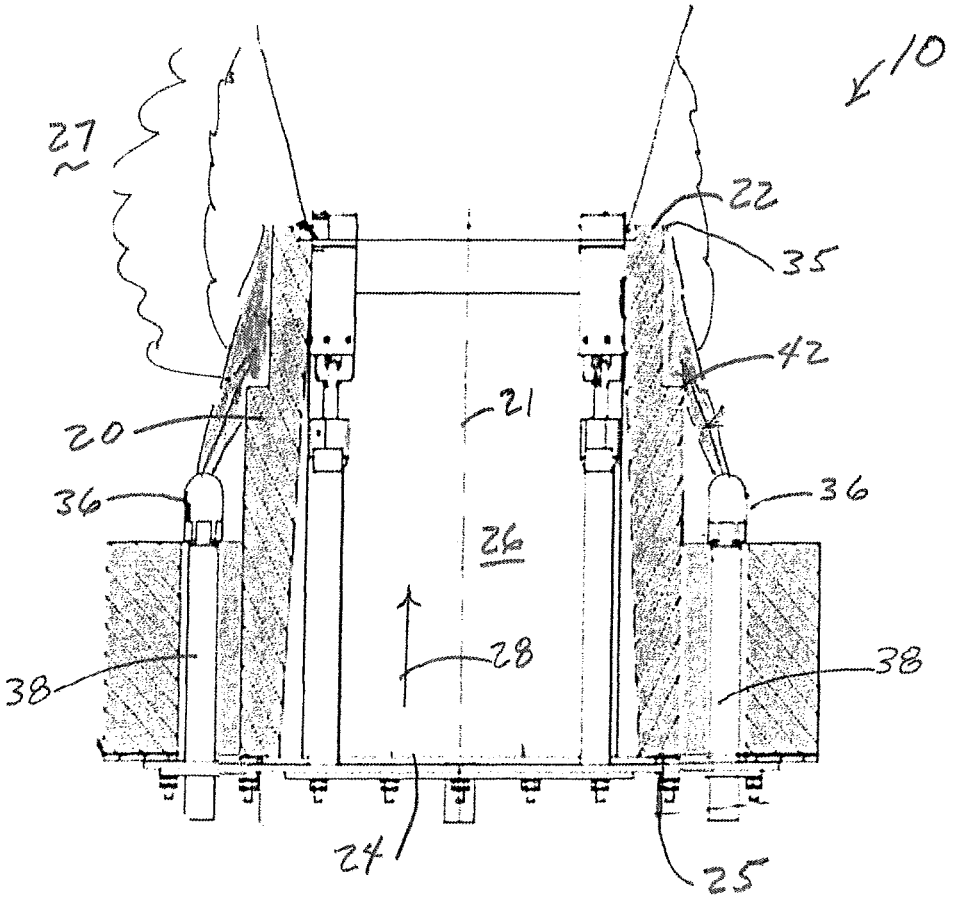
FIG. 7 is a cutaway elevational side view illustrating the inventive burner 10 operating with a high level of excess oxygen in the fired-heating system.

During initial start-up or at other times when the oxygen content within the fired heater 27 is sufficient to sustain combustion of the fuel (typically greater than from 5% to 7% by volume of the total air and/or flue gas present in the fired-heater 27 when the fuel is 100% $H_2$), the main flame of the inventive burner 10 will stabilize close to the ejector tips 36, typically on the intermediate ledge 42 as illustrated in FIG. 7.

Figure 8:
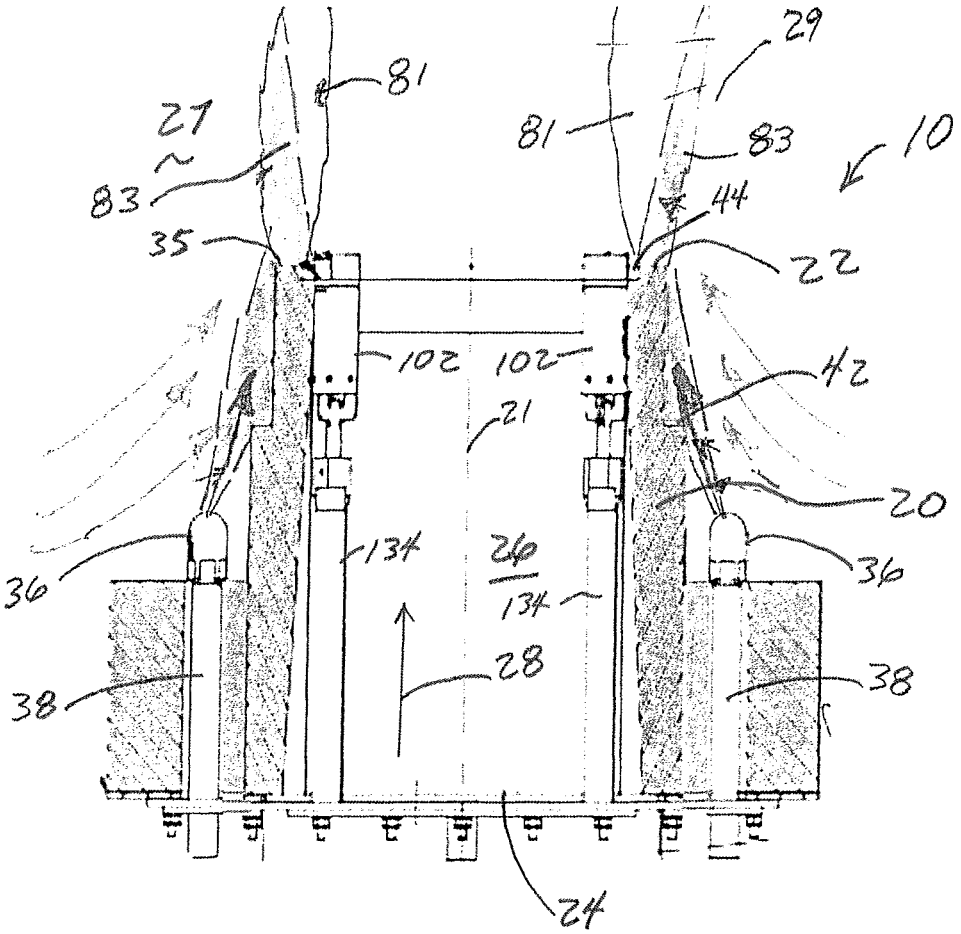
FIG. 8 is a cutaway elevational side view illustrating the inventive burner 10 operating with a low level of excess oxygen in the fired-heating system.

As the oxygen content within the fired-heater 27 declines and/or is adjusted to a level which is not sufficient to sustain combustion of the fuel (typically less than from 5% to 7% by volume of the flue gas present in the fired-heater 27 when the fuel is 100% $H_2$), the main flame of the inventive burner 10 will move forwardly and stabilize on the forward end 22 of the burner wall 20 as illustrated in FIG. 8. The flame which stabilizes on the forward end 22 of the burner wall comprises (a) a primary, fuel-lean, combustion zone 81, closest to the discharge of air or other oxygen-containing gas from the interior passageway 26 of the burner wall 20, in which the amount of air or other oxygen-containing gas is in excess of the fuel and flue gas and (b) an outer secondary, fuel-rich, combustion zone 83 in which a sub-stoichiometric amount of oxygen is present and the amount of flue gas is in excess of the fuel and air. This staged operation and dilution of the combustion mixture slows the rate of combustion of the fuel and lowers the peak flame temperature significantly, thus resulting in Ultra-Low $NO_x$ production.

Because the entire quantity of fuel used in the inventive burner 10 is so well conditioned with the furnace flue gas, combustion occurs at a significantly reduced rate and lower flame temperature, thus resulting in lower $NO_x$ emissions, even when burning up to 100% $H_2$.

In the method of the present invention, the inventive burner 10 is installed in a fired-heating system 27 and a fuel is ejected in free-jet flow from the ejector tips 36. The fuel can be natural gas, refinery fuel gas, hydrogen, or generally any other type of gas and/or liquid fuel used in free-jet burner systems. In order to reduce or substantially eliminate $CO_2$ emissions, the fuel will preferably be a high-$H_2$ fuel as described above or 100% $H_2$. Each fuel stream ejected from the ejector tips 36 will preferably be discharged toward the surrounding outer perimeter 35 of the forward end 22 of the burner wall 20 and/or toward an intermediate ledge 42 or other location on the exterior of the burner wall 20 between the ejector tips 36 and the forward end 22 of the burner wall 20.

Each ejector tip 36 has one or more fuel ejection ports. Most preferably, for each of the ejector tips 36, a center fuel stream 50*c* is ejected from a center ejection port 45*c*, a right fuel stream 50*r* is ejected from a right ejection port 45*r*, and a left fuel stream 50*l* is ejected from a left ejection port 45*l*. The center fuel stream 50*c* is preferably ejected onto the burner wall 20 and/or the surrounding outer perimeter 35 at the forward end 22 thereof in direction toward the longitudinal axis 21. The right fuel stream 50*r* is preferably ejected onto the burner wall 20 and/or the surrounding outer perimeter 35 at the forward end 22 thereof at an angle away from the center fuel stream 50*c* on the right side of the center stream 50*c*. The left fuel stream 50*l* is preferably ejected onto the burner wall 20 and/or the surrounding outer perimeter 35 at the forward end 22 thereof at an angle away from the center fuel stream 50*c* on the left side of the center stream 50*c*.

For each ejector tip 36 of a burner 10 using from three to six ejector tips 36, the angles at which the right and left fuel streams 50*r* and 50*l* of the tip 36 are ejected will preferably be such that the distance along the surrounding outer perimeter 35 of the forward end 22 of the burner wall 20 from (i) the point where the lateral midpoint 53*r* of the right fuel stream 50*r* meets the surrounding outer perimeter 35 of the forward end 22 of the burner wall 20 to (ii) the point where the lateral midpoint 531 of the left fuel stream 50*l* meets the surrounding outer perimeter 35 of the forward end 22 of the burner wall 20 will preferably be from one eighth to one third of the surrounding outer perimeter 35 of the forward end of the burner wall 20. For a burner 10 having only four ejector tips 36, the distance along the surrounding outer perimeter 35 of the forward end 22 of the burner wall 20 from (i) the lateral midpoint 53*r* of the right fuel stream 50*r* at the surrounding outer perimeter 35 of the forward end 22 of the burner wall 20 to (ii) the lateral midpoint 531 of the left fuel stream 50*l* at the surrounding outer perimeter 35 of the forward end 22 of the burner wall 20 will preferably be from one fifth to one third of the surrounding outer perimeter 35 of the forward end of the burner wall 20.

The inventive method also comprises the step of discharging an auxiliary tip flame 130 from one or more auxiliary burner tips 120 onto the forward end 22 of the burner wall 20 or onto a ledge 44 or other interior feature of the burner wall 20.

Using one or more auxiliary burner tips 120 of the type described above, a fuel rich sub-stoichiometric combustion mixture is preferably formed in the mixing chamber 108 of each auxiliary burner tip 102 comprising a gas fuel supplied to the auxiliary burner tip 102. The fuel rich sub-stoichiometric combustion mixture is then discharged from the mixing chamber 108 through the stabilization ring 120 at the forward longitudinal end of the mixing chamber 108 to form a reduced pressure area 140 at or outside of the forward longitudinal end of the mixing chamber 108 which stabilizes the auxiliary tip flame 130 of the auxiliary tip 102. A first portion of the gas fuel is then burned in a sub-stoichiometric combustion region 142 of the auxiliary tip flame 130. Next, the auxiliary tip flame 130 is preferably diverted laterally outward from the sub-stoichiometric combustion region 142 into the stream of air or other oxygen-containing gas 28 in the interior passageway 26 of the burner wall 20 to form a fuel lean combustion region 154 in which the remaining portion of the gas fuel supplied to the auxiliary burner tip 102 is burned.

The total number of the auxiliary burner tips 102 in the burner 10 will preferably be equal to the total number of the ejector tips 36 of the burner 10. Fuel is preferably delivered to each auxiliary tip 102 through an auxiliary fuel line 133 which extends to the auxiliary tip 102 from the main fuel line 37 of a separate one of the ejector tips 36. As noted above, each auxiliary fuel line 133 preferably has a flow orifice therein which is smaller than the large fuel discharge port 132 of the auxiliary tip 102.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. A burner for providing low emissions in a heating system having a flue gas therein, the burner comprising:

a burner wall having a longitudinal axis and a forward end;

an interior passageway of the burner wall for a flow of air or other oxygen-containing gas out of the forward end of the burner wall;

the forward end of the burner wall having a surrounding outer perimeter which measures a total of from 32 to 240 inches around the longitudinal axis of the burner wall;

a series of ejector tips spaced around the longitudinal axis of the burner wall, a total number of the ejector tips of the series being not less than three and not more than six and the ejector tips of the series being positioned longitudinally rearward and laterally outward with respect to the surrounding outer perimeter of the forward end of the burner wall;

each of the ejector tips of the series comprising a center ejection port, a right ejection port, and a left ejection port which are each oriented to eject a fuel stream in free-jet flow toward the surrounding outer perimeter of the forward end of the burner wall and/or toward a location on the burner wall which is different from the surrounding outer perimeter of the forward end of the burner wall;

the fuel stream ejected from the center ejection port of each of the ejector tips of the series being a center fuel stream, the fuel stream ejected from the right ejection port of each of the ejector tips of the series being a right fuel stream, and the fuel stream ejected from the left ejection port of each of the ejector tips of the series being a left fuel stream;

for each of the ejector tips of the series, the right ejection port also being oriented to eject the right fuel stream at an angle away from the center fuel stream on a right side of the center fuel stream, and the left ejection port also being oriented to eject the left fuel stream at an angle away from the center fuel stream on a left side of the center fuel stream; and for each of the ejector tips of the series, a distance along the surrounding outer perimeter of the forward end of the burner wall from (i) a lateral midpoint of the right fuel stream at the surrounding outer perimeter of the forward end of the burner wall to (ii) a lateral midpoint of the left fuel stream at the surrounding outer perimeter of the forward end of the burner wall being equal to from one eighth to one third of the surrounding outer perimeter of the forward end of the burner wall.

2. The burner of claim 1 further comprising the series of the ejector tips consisting of only four of the ejector tips.

3. The burner of claim 2 further comprising, for each of the ejector tips of the series, the distance along the surrounding outer perimeter of the forward end of the burner wall from (i) the lateral midpoint of the right fuel stream at the surrounding outer perimeter of the forward end of the burner wall to (ii) the lateral midpoint of the left fuel stream at the surrounding outer perimeter of the forward end of the burner wall being equal to from one fifth to one third of the surrounding outer perimeter of the forward end of the burner wall.

4. The burner of claim 1 further comprising the surrounding outer perimeter of the forward end of the burner wall being square.

5. The burner of claim 1 further comprising the surrounding outer perimeter of the forward end of the burner wall being circular.

6. The burner of claim 1 further comprising the flow area of each of the center ejection port, the right ejection port, and the left ejection port of each of the ejector tips of the series being at least 0.0068 $inch^2$.

7. A method of operating a burner for low emissions in a heating system having a flue gas therein, the method comprising:

providing a burner in the heating system, the burner comprising a burner wall having a longitudinal axis, a forward end, and an interior passageway through which a stream of air or other oxygen-containing gas flows out of the forward end of the burner wall, the forward end of the burner wall having a surrounding outer perimeter which measures a total of from 32 to 240 inches around the longitudinal axis of the burner wall and ejecting a fuel from a series of ejector tips spaced around the longitudinal axis of the burner wall, a total number of the ejector tips of the series being not less than three and not more than six, the ejector tips of the series being positioned longitudinally rearward and laterally outward with respect to the surrounding outer perimeter of the forward end of the burner wall, and each of the ejector tips of the series comprising a center ejection port, a right ejection port, and a left ejection port ports which each eject a stream of the fuel in free-jet flow toward the surrounding outer perimeter of the forward end of the burner wall and/or toward a location on the burner wall which is different from the surrounding outer perimeter of the forward end of the burner wall, the stream of the fuel ejected from the center ejection port of each of the ejector tips of the series being a center fuel stream, the stream of the fuel ejected from the right ejection port of each of the ejector tips of the series being a right fuel stream, and the stream of the fuel ejected from the left ejection port of each of the ejector tips of the series being a left fuel stream, for each of the ejector tips of the series, the right fuel stream being ejected at an angle away from the center fuel stream on a right side of the center fuel stream, and the left fuel stream being ejected at an angle away from the center fuel stream on a left side of the center fuel stream, and for each of the ejector tips of the series, a distance along the surrounding outer perimeter of the forward end of the burner wall from (i) a lateral midpoint of the right fuel stream at the surrounding outer perimeter of the forward end of the burner wall to (ii) a lateral midpoint of the left fuel stream at the surrounding outer perimeter of the forward end of the burner wall being equal to from one eighth to one third of the surrounding outer perimeter of the forward end of the burner wall.

8. The method of claim 7 further comprising the fuel being at least 50% by weight $H_2$ based upon a total weight of the fuel.

9. The method of claim 7 further comprising the series of the ejector tips consisting of only four of the ejector tips.

10. The method of claim 9 further comprising, for each of the ejector tips of the series, the distance along the surrounding outer perimeter of the forward end of the burner wall from (i) the lateral midpoint of the right fuel stream at the surrounding outer perimeter of the forward end of the burner wall to (ii) the lateral midpoint of the left fuel stream at the surrounding outer perimeter of the forward end of the burner wall being equal to from one fifth to one third of the surrounding outer perimeter of the forward end of the burner wall.

11. The method of claim 9 further comprising the surrounding outer perimeter of the forward end of the burner wall being circular.

12. The method of claim 9 further comprising the surrounding outer perimeter of the forward end of the burner wall being square with only four sides and only one of the ejector tips of the series being located on each of the four sides.

13. A burner for providing low emissions in a heating system having a flue gas therein, the burner comprising:

a burner wall having a longitudinal axis and a forward end;

an interior passageway of the burner wall for a flow of air or other oxygen-containing gas out of the forward end of the burner wall;

the forward end of the burner wall having a surrounding outer perimeter which measures a total of from 32 to 240 inches around the longitudinal axis of the burner wall;

a series of ejector tips spaced around the longitudinal axis of the burner wall, a total number of the ejector tips of the series being not less than three and not more than six and the ejector tips of the series being positioned longitudinally rearward and laterally outward with respect to the surrounding outer perimeter of the forward end of the burner wall;

each of the ejector tips of the series comprising a center ejection port, a right ejection port, and a left ejection port which are each oriented to eject a fuel stream in free-jet flow toward the surrounding outer perimeter of the forward end of the burner wall and/or toward a location on the burner wall which is different from the surrounding outer perimeter of the forward end of the burner wall;

the fuel stream ejected from the center ejection port of each of the ejector tips of the series being a center fuel stream, the fuel stream ejected from the right ejection port of each of the ejector tips of the series being a right fuel stream, and the fuel stream ejected from the left ejection port of each of the ejector tips of the series being a left fuel stream;

for each of the ejector tips of the series, the right ejection port also being oriented to eject the right fuel stream at an angle away from the center fuel stream on a right side of the center fuel stream, and the left ejection port also being oriented to eject the left fuel stream at an angle away from the center fuel stream on a left side of the center fuel stream;

a plurality of auxiliary burner tips in the internal passageway of the burner wall which stabilize a main flame of the burner, each of the auxiliary burner tips having a large fuel discharge port with a flow area of at least 0.012 $inch^2$; and each of the auxiliary burner tips being a sub-stoichiometric, staged air burner tip or a lean pre-mix burner tip.

14. A burner for providing low emissions in a heating system having a flue gas therein, the burner comprising:

a burner wall having a longitudinal axis and a forward end;

an interior passageway of the burner wall for a flow of air or other oxygen-containing gas out of the forward end of the burner wall;

the forward end of the burner wall having a surrounding outer perimeter which measures a total of from 32 to 240 inches around the longitudinal axis of the burner wall;

a series of ejector tips spaced around the longitudinal axis of the burner wall, a total number of the ejector tips of the series being not less than three and not more than six and the ejector tips of the series being positioned longitudinally rearward and laterally outward with respect to the surrounding outer perimeter of the forward end of the burner wall;

each of the ejector tips of the series comprising a center ejection port, a right ejection port, and a left ejection port which are each oriented to eject a fuel stream in free-jet flow toward the surrounding outer perimeter of the forward end of the burner wall and/or toward a location on the burner wall which is different from the surrounding outer perimeter of the forward end of the burner wall;

the fuel stream ejected from the center ejection port of each of the ejector tips of the series being a center fuel stream, the fuel stream ejected from the right ejection port of each of the ejector tips of the series being a right fuel stream, and the fuel stream ejected from the left ejection port of each of the ejector tips of the series being a left fuel stream;

for each of the ejector tips of the series, the right ejection port also being oriented to eject the right fuel stream at an angle away from the center fuel stream on a right side of the center fuel stream, and the left ejection port also being oriented to eject the left fuel stream at an angle away from the center fuel stream on a left side of the center fuel stream;

a plurality of auxiliary burner tips in the internal passageway of the burner wall which stabilize a main flame of the burner, each of the auxiliary burner tips having a large fuel discharge port with a flow area of at least 0.012 $inch^2$; and each of the auxiliary burner tips further comprising a shield housing having a mixing chamber therein and a longitudinally extending outer wall which surrounds the mixing chamber, a gas fuel spud which includes the large fuel discharge port, the large fuel discharge port of the gas fuel spud being positioned to discharge a gas fuel into a rearward longitudinal end of the mixing chamber, a lateral base wall of the shield housing at a rearward longitudinal end of the mixing chamber, the lateral base wall having at least a central opening provided therethrough, a lateral flame stabilization ring of the shield housing at a forward longitudinal end of the mixing chamber, the flame stabilization ring having a discharge opening for the mixing chamber provided therethrough, and a flame diverter on a forward longitudinal end of the shield housing.

15. A burner for providing low emissions in a heating system having a flue gas therein, the burner comprising:

a burner wall having a longitudinal axis and a forward end;

an interior passageway of the burner wall for a flow of air or other oxygen-containing gas out of the forward end of the burner wall;

the forward end of the burner wall having a surrounding outer perimeter which measures a total of from 32 to 240 inches around the longitudinal axis of the burner wall;

a series of ejector tips spaced around the longitudinal axis of the burner wall, a total number of the ejector tips of the series being not less than three and not more than six and the ejector tips of the series being positioned longitudinally rearward and laterally outward with respect to the surrounding outer perimeter of the forward end of the burner wall;

each of the ejector tips of the series comprising a center ejection port, a right ejection port, and a left ejection port which are each oriented to eject a fuel stream in free-jet flow toward the surrounding outer perimeter of the forward end of the burner wall and/or toward a location on the burner wall which is different from the surrounding outer perimeter of the forward end of the burner wall;

the fuel stream ejected from the center ejection port of each of the ejector tips of the series being a center fuel stream, the fuel stream ejected from the right ejection port of each of the ejector tips of the series being a right fuel stream, and the fuel stream ejected from the left ejection port of each of the ejector tips of the series being a left fuel stream;

for each of the ejector tips of the series, the right ejection port also being oriented to eject the right fuel stream at an angle away from the center fuel stream on a right side of the center fuel stream, and the left ejection port also being oriented to eject the left fuel stream at an angle away from the center fuel stream on a left side of the center fuel stream;

a plurality of auxiliary burner tips in the internal passageway of the burner wall which stabilize a main flame of the burner, each of the auxiliary burner tips having a large fuel discharge port with a flow area of at least 0.012 $inch^2$;

a total number of the auxiliary burner tips in the burner being equal to the total number of the ejector tips of the series;

each of the ejector tips of the series having a main fuel line extending thereto which includes a main fuel riser;

each of the auxiliary burner tips having an auxiliary fuel line extending thereto from the main fuel line of a separate one of the ejector tips of the series, each said auxiliary fuel line including an auxiliary fuel riser; and each said auxiliary fuel line having a flow orifice therein.

16. The burner of claim 15 further comprising:

the large fuel discharge port of each of the auxiliary burner tips having a flow area of at least 0.049 $inch^2$;

the flow orifice in each said auxiliary fuel line having a flow area of at least 0.012 $inch^2$; and the flow area of the large fuel discharge port of each of the auxiliary burner tips being larger than the flow area of the flow orifice in each said auxiliary fuel line.

17. The burner of claim 15 further comprising each of the auxiliary burner tips being oriented to discharge an auxiliary burner flame onto the forward end of the burner wall or onto an interior ledge or other interior feature of the burner wall.

18. A method of operating a burner for low emissions in a heating system having a flue gas therein, the method comprising:

providing a burner in the heating system, the burner comprising a burner wall having a longitudinal axis, a forward end, and an interior passageway through which a stream of air or other oxygen-containing gas flows out of the forward end of the burner wall, the forward end of the burner wall having a surrounding outer perimeter which measures a total of from 32 to 240 inches around the longitudinal axis of the burner wall;

ejecting a fuel from a series of ejector tips spaced around the longitudinal axis of the burner wall, a total number of the ejector tips of the series being not less than three and not more than six, the ejector tips of the series being positioned longitudinally rearward and laterally outward with respect to the surrounding outer perimeter of the forward end of the burner wall, and each of the ejector tips of the series comprising a center ejection port, a right ejection port, and a left ejection port which each eject a stream of the fuel in free-jet flow toward the surrounding outer perimeter of the forward end of the burner wall and/or toward a location on the burner wall which is different from the surrounding outer perimeter of the forward end of the burner wall;

the stream of the fuel ejected from the center ejection port of each of the ejector tips of the series being a center fuel stream, the stream of the fuel ejected from the right ejection port of each of the ejector tips of the series being a right fuel stream, and the stream of the fuel ejected from the left ejection port of each of the ejector tips of the series being a left fuel stream;

for each of the ejector tips of the series, the right fuel stream being ejected at an angle away from the center fuel stream on a right side of the center fuel stream, and the left fuel stream being ejected at an angle away from the center fuel stream on a left side of the center fuel stream; and operating each of one or more auxiliary burner tips positioned in the interior passageway of the burner wall to direct an auxiliary tip flame onto the forward end of the burner wall or onto a ledge or other interior feature of the burner wall.

19. The method of claim 18 further comprising for each of the one or more auxiliary burner tips:

forming a fuel rich sub-stoichiometric combustion mixture in the auxiliary burner tip comprising a gas fuel supplied to the auxiliary burner tip, burning a first portion of the gas fuel supplied to the auxiliary burner tip in a sub-stoichiometric combustion region of the auxiliary tip flame, and diverting the auxiliary tip flame laterally outward from the sub-stoichiometric combustion region into the stream of air or other oxygen-containing gas in the interior passageway of the burner wall to form a fuel lean combustion region of the auxiliary tip flame in which a remaining portion of the gas fuel supplied to the auxiliary burner tip is burned.

20. The method of claim 19 further comprising for each of the one or more auxiliary burner tips, discharging the fuel rich sub-stoichiometric combustion mixture from a mixing chamber in the auxiliary burner tip through a stabilization ring at a forward longitudinal end of the mixing chamber to form a reduced pressure area at or outside of the forward longitudinal end of the mixing chamber which stabilizes the auxiliary tip flame of the auxiliary burner tip.

21. The method of claim 18 further comprising:

a total number of the auxiliary burner tips in the burner being equal to the total number of the ejector tips of the series;

each of the ejector tips of the series having a main fuel line extending thereto which includes a main fuel riser;

each of the auxiliary burner tips having an auxiliary fuel line extending thereto from the main fuel line of a separate one of the ejector tips of the series, each said auxiliary fuel line including an auxiliary fuel riser;

each said auxiliary fuel line having a flow orifice therein; and a gas fuel being supplied to each one of the auxiliary burner tips via the auxiliary fuel line which extends thereto from the main fuel line of the separate one of the ejector tips of the series.

22. The method of claim 21 further comprising:

each of the one or more auxiliary burner tips having a large fuel discharge port having a flow area of at least 0.049 $inch^2$ through which the gas fuel supplied to the auxiliary burner tip is delivered;

each said flow orifice having a flow area of at least 0.012 $inch^2$; and the flow area of the large fuel discharge port of each of the auxiliary burner tips being larger than the flow area of the flow orifice in each said auxiliary fuel line.

* * * * *